United States Patent [19]

Tisma

[11] Patent Number: 4,745,732

[45] Date of Patent: May 24, 1988

[54] PACKAGING MACHINES HAVING CHART SETTING CAPABILITIES

[75] Inventor: Steven Tisma, Chicago, Ill.

[73] Assignee: Tisma Machine Corporation, Chicago, Ill.

[21] Appl. No.: 907,497

[22] Filed: Sep. 15, 1986

[51] Int. Cl.[4] ..... B65B 43/14; B65B 43/26

[52] U.S. Cl. ..... 53/564; 53/579; 221/197

[58] Field of Search ..... 53/565, 566, 571, 573, 53/564, 579; 221/189, 197

[56] References Cited

U.S. PATENT DOCUMENTS

| | | | |
|---|---|---|---|
| 3,412,652 | 11/1968 | McIntyre | 53/566 X |
| 3,633,470 | 1/1972 | Bingham | 53/566 X |
| 3,827,687 | 8/1974 | Kono | 221/197 X |
| 4,348,853 | 9/1982 | Morse et al. | 53/571 X |
| 4,578,929 | 4/1986 | Tisma | 53/579 X |

*Primary Examiner*—Horace M. Culver

*Attorney, Agent, or Firm*—Laff, Whitesel, Conte & Saret

[57] ABSTRACT

An automatic packaging machine has a table with a conveyor mounted thereon to carry a plurality of mandrels. A magazine for cardboard blanks is on a swinging arm which is pivotally mounted on the table, for feeding the blanks toward the mandrels on the conveyor. A pick up includes vacuum cups on a revolving platform which moves the individual blanks from the magazine to individual ones of the mandrels. A circular scale centered on the pivot point enables a swinging of the arm to an azimuth at which the pick up may engage and carry individual blanks. The arm carries a linearly movable fence for holding the blanks in alignment. A linearly moving block is slidably mounted on a pair of guide bars extending perpendicularly away from the swinging arm. A feed screw extends through the block to the arm, whereby the block slides toward or away from the arm responsive to a turning of the feed screw. A linear scale extends between said arm and an end support bracket mounted on the guide bars for identifying the position of the block. The machine is easily upgraded to provide robot operation.

16 Claims, 2 Drawing Sheets

PACKAGING MACHINES HAVING CHART SETTING CAPABILITIES

Figure 1:
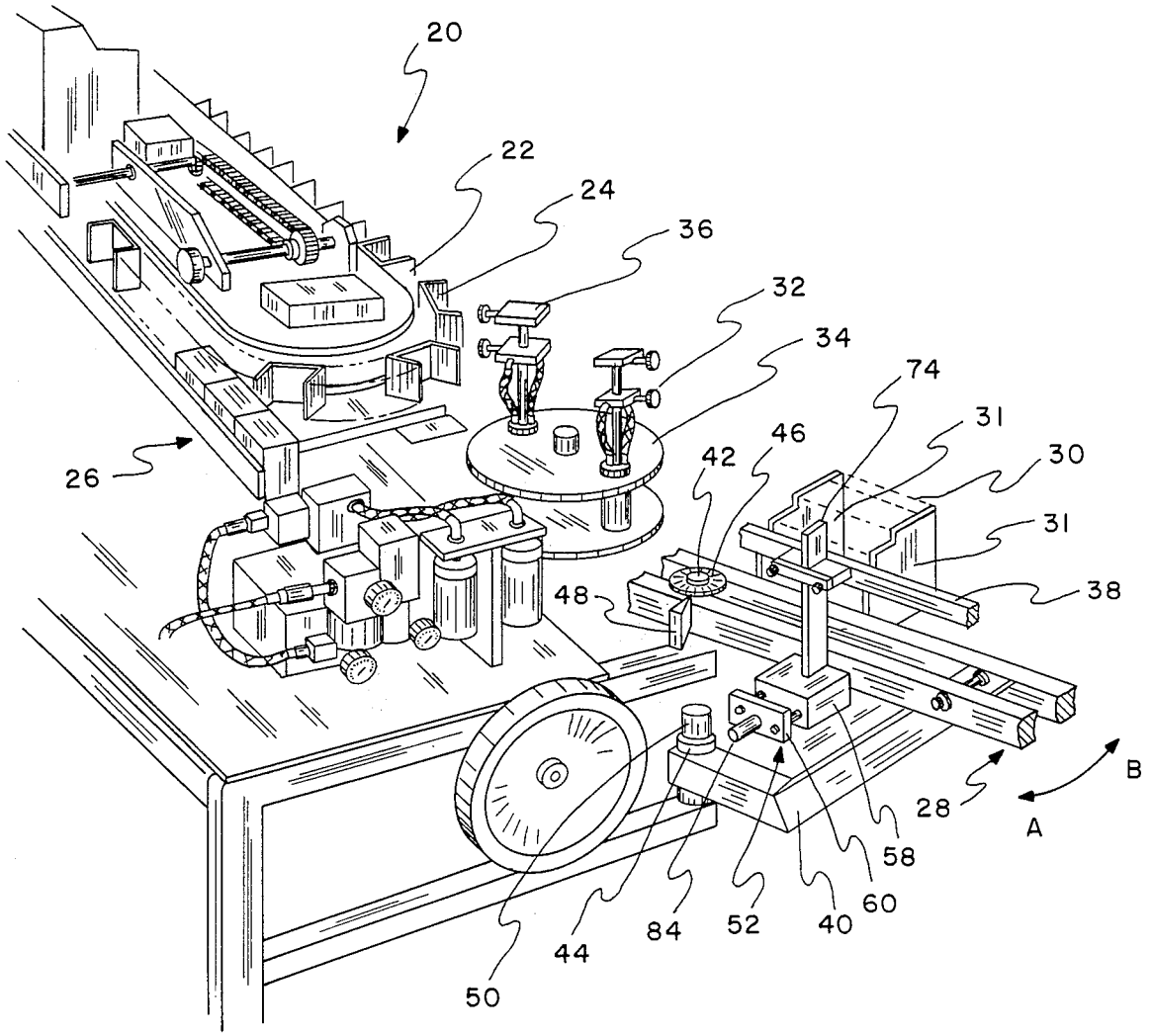

This invention relates to automatic packaging machines and more particularly to robotized packaging machines having chart setting capabilities.

U.S. Pat. No. 4,578,929 granted Apr. 1, 1986 shows one example of an automatic packaging machine which may be automated to a robot status. There are, of course, many other machines which could also be cited to show prior art automatic packaging machines.

These and similar machines are readily adaptable to fill boxes of many different shapes and sizes. However, it requires a substantial amount of man hours by persons with a high skill level everytime that it becomes necessary to change over the packaging machine from use with one type of box to use with another type of box. Usually, this change over has involved a loosening of parts of the automatic packaging machine, resetting the loosened part with great accuracy, and then re-tightening the loosened part. Usually the resetting requires a use of gauge rods or blocks, intuition, judgment, and much trial and error. Very often, the act of re-tightening causes the part to move slightly, and then the process has to be repeated.

Also, in the past many of these and similar adjustments involved a use of such precise measuring that a high skill level and worker judgment was involved. There was no simple and easy way of directly reading the new positions in which the various parts are set. Thus, the prior art teaches a use of machines which are labor intensive.

The present trend in packaging machine design is to install microprocessors for providing a robot operation of the machines. However, at the present time, there are also many users who are not equipped or trained to use robots; thus, they still want to operate in traditional ways. Nevertheless, they expect that, before very long, they will want machines which are robots working without close and immediate human supervision. Thus, they want machines which may be upgraded to a robot status. It will then be necessary to convert the machines so that a person sitting at a keyboard may type in a few instructions, after which the machine will completely readjust itself. The operator may then want to inspect the machine to be sure that it has, in fact, readjusted itself, as directed. Thus, there is a demand for traditional machines which may be upgraded to robotic operation at a minimum cost.

Accordingly, an object of the invention is to provide either automatic packaging machines which are able to be quickly adjusted or to quickly adjust themselves, in order to position or reposition their parts, in response to a minimal human supervision. Here, an object is to provide a chart set system for any of many different types of automatic production machines.

An object of the invention is to provide automatic packaging machines which have scales and sitting circles that enable them to be manually set without requiring the kind of measurements which involve or require a high level of user skills.

Another object of the invention is to provide automatic packaging machines which may be changed over from one to another box size or style, quickly and easily.

Still another object of the invention is to provide an initially, manually adjusted automatic packaging machine which may be easily upgraded to become a robot.

In keeping with an aspect of the invention, these and other objects are accomplished by providing charting devices at all locations on automatic packaging machines where adjustments of part positions are to be made. Those devices are rulers or setting circles which can be read directly from index devices on the parts. Initially, hand wheels or cranks may be provided to move the parts while the charting devices are being read. When it is desirable to robotize the automatic packaging machines, microprocessor controlled stepping motors may be substituted for the hand wheels or cranks. Either way, the accuracy of the settings may be confirmed by glancing at the charting devices.

Figure 2:
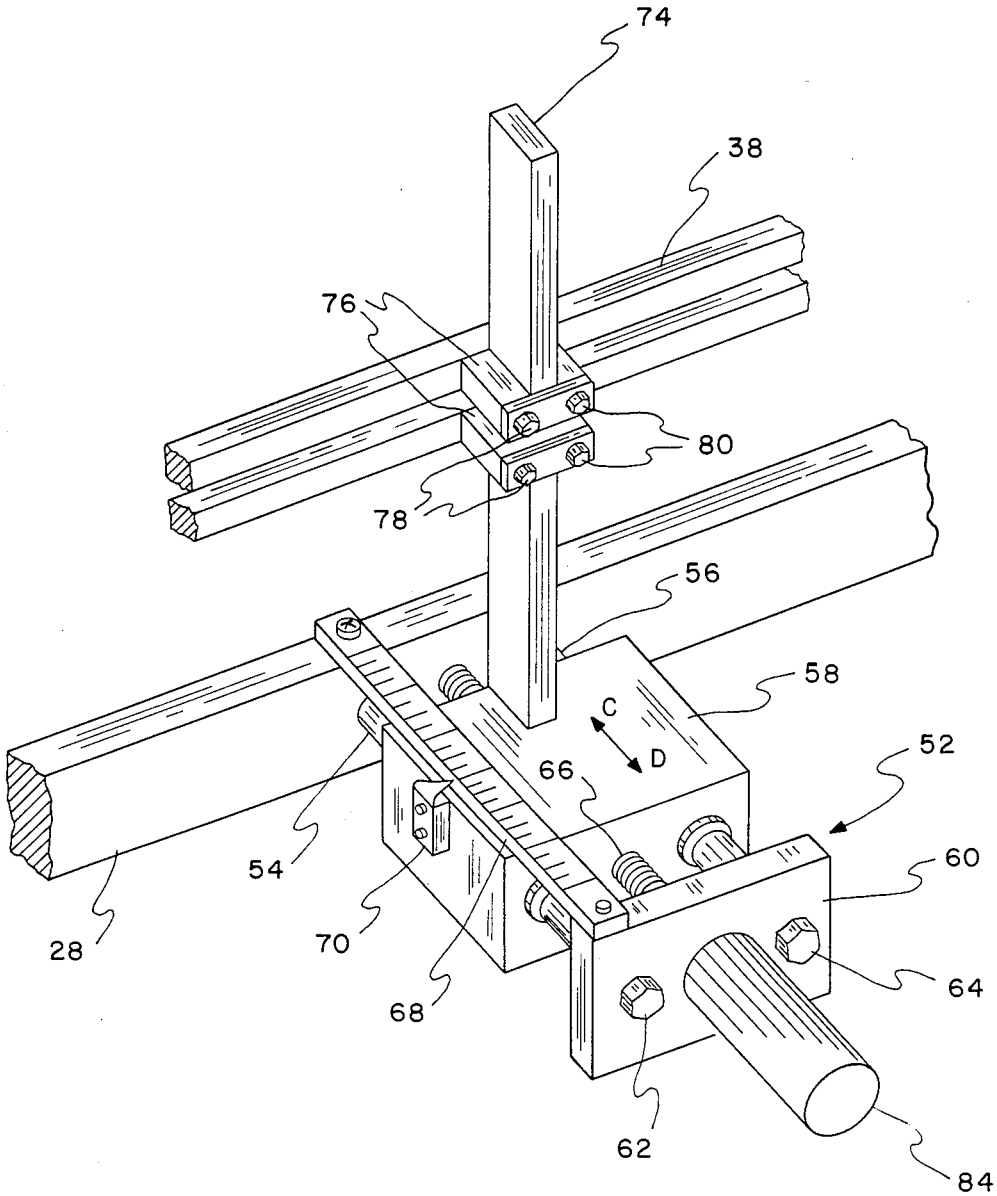

A preferred embodiment of the invention shown in the attached drawing wherein:

FIG. 1 is a perspective view of a machine having an arm with an angularly adjustable azimuth and with a linearly adjustable fence for feeding blanks in an automatic packaging machine; and FIG. 2 is a perspective view of the adjustable fence, which may be mounted on the arm of FIG. 1.

An examplary automatic packaging machine 20 (FIG. 1) has a conveyor 22 carrying a number of mandrels (such as 24) for transporting boxes which are to be filled. The equipment for actually forming, filling, closing, and sealing the boxes may take any well known form, and therefore, they are not shown in FIG. 1. Reference may be made to U.S. Pat. No. 4,578,929 for an example of such equipment. After the boxes are sealed, they are delivered to an output station 26, as here shown by three exemplary boxes. There may be any suitable conveyors (not shown) for carrying away these boxes.

Associated with the conveyor 22, may be any other suitable equipment, here represented by an arm 28 which may swing back and forth in directions A, B, depending upon the instantaneous functions, being performed by the machine. In this particular example, the arm 28 is shown as having a magazine 30 for holding cardboard blanks 31 which may be formed into boxes.

These cardboard blanks 31 are picked up, one at a time by a first pair of vacuum cups (at pick up position 32) mounted on a revolving platform 34. Once the blank is picked up, the platform 34 rotates through 180° where the vacuum cups formerly at pick up position 32 reach the output position 36. There, the picked up blank 31 is deposited in one of the mandrels 24. Meanwhile, the vacuum cups which were at the output position 36 have rotated to the pickup position 32, where they pick up the next blank 31 in magazine 30.

It seems quite apparent that it is necessary to very carefully align the azimuth of arm 28 relative to the position revolving platform 34, if the pick up is to be successful. Moreover, each time that the machine is changed over to run a different blank for a new shape or size of box, it is necessary to readjust the position of the arm 28.

Heretofore, this readjustment has been made primarily on a trial and error basis, which is to set the arm, run the machine, observe the operation, reset the arm, rerun the machine, etc. This setting and resetting has required highly skilled machanics who are able to intuitively judge when the arm 28 is properly set.

In the not too distant future, the machines will likely have a control mechanism which may be commanded to automatically take a preselected number of steps in order for the arm 28 to reach a proper position. Meanwhile, it is necessary to provide a machine which may be adjusted manually, and which may be upgraded in the future to become more fully automated.

The cardboard blanks 31 in the magazine 30 are held in place, in part, by a fence 38 which extends along the length of arm 28. When a relatively narrow blank is in place in the magazine, the fence must be moved toward the blank (i.e. away from the viewer of FIG. 1). When a relatively wide blank is in place, the fence must be moved back (i.e. toward the viewer). Again, it is desirable to provide a means by which the exact fence position may be adjusted, either manually or automatically, and which may be upgraded to robot operation.

In keeping with the invention, chart devices or scales are applied to these and similar movable parts so that a manual adjustment may be made as easily as reading a ruler or protractor. Thus, when manually setting the machine, it is done by observing a pointer associated with a permanent scale, as distinguished from trial and error or a use of gauge blocks or rods, for example. The manual adjustments are made by hand wheels or cranks for moving feed screws. When automated, motors (such as stepping motors) for example, may be operated to drive the feeds screws which move the parts to a precise position. Then, the scales may be observed to determine that the parts have, in fact, been positioned accurately.

In greater detail, the arm 28 is supported by a dependent bracket 40, which are pivotally mounted on upper and lower bearings 42, 44. When junctions between these bearings, the arm, and bracket are loosened, the arm may be swung in directions A, B to any convenient location. Then, the junctions are tightened to secure the arm 28 in position.

A chart or scale plate 46 is secured to the stationary part of the bearing 42. Preferably, the chart or scale plate 46 is engraved with either the 360° of a circle or a numerical scale which is dedicated to the particular machine. For example, there could be a "#5" on plate 46 to indicate that this is the setting for a #5 box. A pointer 48 is secured to and moves with the arm 28. Thus, as the arm 28 swings, its position relative to the machine 29 is always indicated by the pointer 48 identifying a particular reading on the scale 46.

When the machine is automated, a stepping motor 50 may be added to swing the arm over an arc corresponding to a specific number of steps undertaken by stepping motor 50. After the motor stops, an inspection of the position of pointer 48 relative to scale 46 confirms the proper positioning thereof.

The mechanism 52 for adjusting the position of such a linearly moving part, (e.g. the fence 38) is shown in detail in FIG. 2. A plurality of the fence support mechanisms 52 may be distributed along the length of the arm 28. At each fence support position, the arm 28 has a pair of guide bars 54, 56 extending perpendicularly and horizontally therefrom. A first block 58 is mounted to slide back and forth along these guide bars, in directions C, D. An end bracket 60 is affixed to the outer and free ends of the guide bars 54, 56, by means of nuts 62, 64.

A feed screw 66 turns within a threaded hole through the block 58. Thus, if the feed screw is turned in one direction, the block 58 moves in direction C. If the feed screw turns in the opposite direction, the block 58 moves in direction D.

A scale 68, in the form of a ruler, is attached between the arm 28 and the end bracket 60. The scale may be engraved on ruler 68 in any convenient form, such as an inch or centimeter scale. Also, the scale may be in terms of a particular dedicated product, such as a "#5" for a box #5. A pointer 70 is secured to and moves with the block 58 to identify a position on the scale 68. Thus, by reading the scale under the end of the pointer 70, it is possible to know exactly how far the block 58 is away from the arm 28.

It should be noted that, if all scales on the machine are marked with a product number, such as the afore mentioned #5, every scale may be set to #5 whenever a number 5 box is to be run. The person who is making the adjustments does not have to know what he is doing, except to set a scale by typing in a "#5" or the like.

Upstanding on and affixed to the block 58 is a post 74. The fence 38 is mounted on post 74 by means of clamps 76. After the loosening of screws 78, 80, fence 38 may be moved to any suitable vertical height. Then, the sorews 7B, 80 are tightened to secure the fence in place.

It should now be apparent that the fence 38 moves back and forth in directions C, D, in response to a turning of the feed screw 66. In the manual mode, a hand wheel may be located at position 84 to turn the feed screw.

In order to automate the device of FIG. 2, a stepping motor 84 may be installed to turn the feed screw 66. Thus, the motor may be commanded to take a predetermined number of steps. Then, the position of pointer 70 may be observed on scale 68 to verify that the block 58 is, in fact, in its commanded position.

It should be apparent that the principles which have been described may be applied at many different places in the machine of FIG. 1 since the position of almost every part may be defined in terms of either an azimuth or a distance from a reference point. The resulting position is read by a pointer 48 or 70. The azimuth is indicated on a circular scale 46, the distance is indicated on a linear scale 68. In some cases, it may be desirable to use both the circular and the linear scales to more precisely fix the location of a part.

The advantages of the chart setting of the invention are a quicker, easier and more accurate way of setting up a new production run; a reduction in the skill level required of workers who maintain the machine; and a semi-automatic machine which can easily be upgraded to become a fully automatic packaging robot.

Those who are skilled in the art will readily perceive how to modify the invention. Therefore, the appended claims are to be construed to cover all equivalent structures which fall within the true scope and spirit of the invention.

THE CLAIMED INVENTION IS:

1. In an automatic packaging machine an assembly comprising a table having a radially movable arm attached thereto at a pivot point about which the arm swings, a circular scale mounted at said pivot point, a pointer associated with said scale for indicating an azimuth at which said arm extends away from said table, means for linearly moving a part relative to said machine, linear scale means extending from said machine past said linearly moving part, and pointer means associated with said linearly moving part for identifying on the linear scale the position of said linearly moving part.

2. The automatic packaging machine assembly of claim 1 and power operated means for moving said arm and said linearly moving part to commanded locations which may be confirmed by observing the position of said pointers relative to said scales.

3. The automatic packaging machine assembly of claim 2 wherein said power operated means include at least one stepping motor associated with each of said scales.

4. The automatic packaging machine assembly of claim 1 wherein said linearly moving part comprises at least one guide bar extending perpendicularly away from said arm and to an end bracket support, a block slidably movable on said guide bar, and a feed screw extending from said end bracket through said block to said arm whereby said block slides on said guide bar toward or away from said arm responsive to a turning of said feed screw, said linear scale means extending between said arm and said end bracket support.

5. The automatic packaging machine assembly of claim 1 wherein said arm includes a magazine for holding a plurality of cardboard blanks and said linearly moving part comprises a fence in said magazine for holding said blanks in alignment, and pick up means on said table near the pivot point of said arm, the blanks being presented to said pick up means when said arm is set at an angle determined by said azimuth.

6. The automatic packaging machine assembly of claim 5 wherein said pick up means includes a revolving platform, a plurality of vacuum cups mounted on said revolving platform at locations which bring said vacuum cups into contact with said blanks in said magazine when said arm is setting at said azimuth.

7. The automatic packaging machine assembly of claim 6 and power operated means comprising at least one stepping motor associated with each of said scales for moving said arm and said linearly moving part to selected locations which may be confirmed by observing the positions of said pointers on said scales.

8. In an automatic packaging machine, an assembly comprising a table having conveyor means mounted thereon, a plurality of mandrels mounted on and carried by said conveyor, a magazine means pivotally mounted on said table for feeding cardboard blanks toward said conveyor, pick up means for moving individual blanks from said magazine to individual ones of said mandrels, means for pivoting said magazine to an azimuth which enables said pick up means to engage and carry said individual blanks, and scale means for reading out said azimuth whereby said magazine may be set at said azimuth by observing said azimuth reading on said chart.

9. The automatic packaging machine assembly of claim 8 wherein said means for reading said azimuth comprises a circular scale centered upon said pivotal mount, and pointer means for identifying a point on said circular scale, one of said pointer and scale means being associated with said table and the other of said pointer and scale being associated with magazine.

10. The automatic packaging machine assembly of claim 9 wherein said circular scale reads out said azimuth in terms related to the particular type of blank that is in said magazine.

11. The automatic packaging machine assembly of claim 8 wherein said magazine means has an arm with an associated linearly moving part comprising a fence for holding said blanks in alignment, said linearly moving part comprising at least one guide bar extending perpendicularly away from said arm and to an end bracket support, a block slidably movable on said guide bar, and a feed screw extending through said block to said arm whereby said block slides toward or away from said arm responsive to a turning of said feed screw, said linear scale means extending between said arm and said end bracket support.

12. In an automatic machine, an assembly comprising means including movable mechanical parts operating at any of a plurality of different settings whereby there is a need to reset said mechanical parts of said machine between different operations, said mechanical parts including guide bars extending along a path from end point to end point which is followed by at least one of said movable parts for said resetting, a block mounted to travel freely along said guide bars, a feed screw threaded through said block for causing said block to move along said path responsive to a turning of said feed screw, a scale means mounted on said end points and spanning said path, and pointer means associated with said block for identifying on said scale means the position of said block in said path.

13. The machine assembly of claim 12 and means carried by said block for adjusting said machine.

14. The machine assembly of claim 13 and a stepping motor for turning said feed screw responsive to automatic commands.

15. The machine assembly of claim 13 and a pivot point about which at least one of said moving parts swings, a scale means including at least an arc of a circle centered on said pivot point for identifying an azimuth of said swinging part, and pointer means on said swinging part for identifying on said accurate scale a position of said swinging part.

16. The machine assembly of claim 15 wherein said machine is an automatic packaging machine with a cardboard blank magazine mounted on said swinging part which is an arm turning about said pivot point, said block carrying a fence for holding said cardboard blanks in an alignment on said arm, and means comprising a pick up device positioned between an end of said arm and said packaging machine.

* * * * *